US005237882A

United States Patent [19]

Giometti

[11] Patent Number: 5,237,882

[45] Date of Patent: Aug. 24, 1993

[54] ENGINE STARTER GEARING WITH LAMINATED CUSHION WASHERS

[75] Inventor: Paul F. Giometti, Horseheads, N.Y.

[73] Assignee: Purolator Products Company, Tulsa, Okla.

[21] Appl. No.: 701,023

[22] Filed: May 16, 1991

[51] Int. Cl.[5] ..... F02N 15/06

[52] U.S. Cl. ..... 74/7 A; 74/6; 74/7 C; 192/103 A; 192/114 R

[58] Field of Search ..... 7/6, 7 R, 7 A, 7 C; 192/103 A, 114 R

[56] References Cited

U.S. PATENT DOCUMENTS

| | | | |
|---|---|---|---|
| 4,425,812 | 1/1984 | Williams | 74/7 R X |
| 4,611,499 | 9/1986 | Giometti | 74/7 A X |
| 4,627,299 | 12/1986 | Mortensen, Sr. | 74/7 A |
| 4,712,435 | 12/1987 | Losey et al. | 74/7 A X |
| 4,744,258 | 5/1988 | Volino | 74/7 R |
| 4,748,862 | 6/1988 | Johnston | 74/7 R |
| 4,768,392 | 9/1988 | Giometti | 74/7 A X |
| 4,777,836 | 10/1988 | Giometti | 74/7 R X |
| 4,843,897 | 7/1989 | Tallis, Jr. | 74/7 A X |
| 5,042,312 | 8/1991 | Giometti | 74/7 C X |
| 5,050,441 | 9/1991 | Giometti | 74/7 C |

*Primary Examiner*—Allan D. Herrmann
*Attorney, Agent, or Firm*—Remy J. VanOphem

[57] ABSTRACT

Centrifugally disengageable engine starter gearing for selectively starting an engine having a starting gear. The engine starter gearing includes a power shaft, a sleeve slidably secured to the power shaft, a pinion gear slidably mounted to the power shaft and movable into engagement with the starting gear, a driven clutch member secured to the pinion gear and having a circular recess therein, a driving clutch member mounted to the sleeve, and mutually engageable clutch teeth on the driving and driven clutch members. A housing having an open end and a closed end is fitted over the driving and driven clutch members. An abutment confines the driving and driven clutch members within the housing. A radially inwardly extending shoulder is located on the driving clutch member adjacent the circular recess. An annular thrust washer having an inner conical surface abuts a loose washer which abuts the radially inwardly extending shoulder. A plurality of centrifugal flyweight members are annularly arranged and supported within the circular recess. Each centrifugal flyweight member has an inclined surface abutting the conical surface of the thrust washer and is operative to displace the thrust washer toward the driving clutch member in response to a centrifugal force. A resilient member and a plurality of cushion washers are compressibly retained between the closed end of the housing and a radial shoulder on the sleeve. The cushion washers act to reduce the measurable torque over unit time within the engine starter gearing, and thus improve the ability of the resilient member to more fully absorb the peak torque loads imposed by the engine during start-up and misfire.

14 Claims, 2 Drawing Sheets

ENGINE STARTER GEARING WITH LAMINATED CUSHION WASHERS

BACKGROUND OF THE INVENTION

1. Field of the Invention

The present invention generally relates to engine starter gearing for an engine. More specifically, this invention relates to engine starter gearing of a positive shift type including a dentil clutch to provide driving and overrunning features and provisions for effecting the automatic separation of the clutch teeth after the engine becomes self-running, and further including means for improving the ability of the engine starter gearing to dissipate the peak torque imposed upon the engine starter gearing during its operation.

2. Description of the Prior Art

The present invention is an improvement over the starter gearing system described in U.S. Pat. No. 3,263,509 entitled "Engine Starter Gearing", issued Aug. 2, 1966, to Digby. The starter gearing system taught by Digby is used to engage and drive an engine ring gear for purposes of starting an engine.

The Digby patent disclosed an engine starter gearing using centrifugal weights and a conical thrust washer for separating dentil clutch teeth after engine start-up to prevent long periods of clutch overrunning and accompanying deleterious wear on the clutch teeth. A driving clutch member and a driven clutch member have complementary mutually engageable inclined dentil teeth for transmitting torque therebetween in one direction of relative rotation. An annular recess is formed in the driving clutch member and a circular recess is provided in the face of the driven clutch member facing the driving clutch member. An annular thrust washer is fitted in the annular recess and abuts the driving clutch member. A conical surface is provided on the annular thrust washer facing the driven clutch member. The centrifugal weights are also disposed in the circular recess and each are provided with an inclined surface which coacts with the conical surface in the annular thrust washer such that when an overrunning condition occurs, the centrifugal weights move radially outwardly and the inclined surface engages the conical surface of the annular thrust washer so as to bias the driving clutch member away from the driven clutch member.

The above described components are all enclosed within a housing through which extends a power shaft. The housing has an open end and a closed end which circumscribes the power shaft. Both the driving and the driven clutch members are concentrically located within the housing on a sleeve which extends through the housing, encasing and slidably splined to that portion of the power shaft which resides within the housing. The driving clutch member is centrally positioned within the housing and has helical splines which engage mating helical splines on the circumference of the sleeve. The driven clutch member is positioned at the open end of the housing and, while being prevented from axial displacement relative to the housing by a snap ring, is rotatably restricted only by the engagement of its dentil clutch teeth with those of the driving clutch member. A pinion which is engageable with the engine ring gear is rigidly attached to the driven clutch member opposite the driving clutch member. A compression spring is used to bias the driving clutch member against the driven clutch member to maintain engagement of the dentil clutch teeth.

For purposes of absorbing torsional shock loads imposed by the engine ring gear on the engine starter gearing, Digby taught the use of a resilient cushion positioned between the closed end of the housing and a radial shoulder of the sleeve located between the closed end and the driving clutch member. A disk is positioned between the resilient member and the shoulder such that it compresses the resilient member against the closed end of the housing. The disk also forms the base from which the compression spring is biased against the driving clutch member. The resulting structure is substantially rigid due primarily to the precompressed resilient member.

Most importantly, the resilient member absorbs the torsional shock transmitted from the engine ring gear during start-up of the engine. Common sources of such torsional shock include the torsional resistance of the engine ring gear when the engine starter gearing first engages the stationary engine ring gear and when the engine ring gear momentarily stops as a result of engine misfire. As a consequence of the driving clutch member being engaged with the sleeve via the helical splines, the torsional shock load is transformed into an axial shock load which results as the driving clutch member, and consequently the pinion and driven clutch member via the meshed dentil clutch teeth, advance toward the engine ring gear. As a result of the axial displacement of the driven clutch member being restricted relative to the housing, the housing is also urged toward the engine ring gear. This displacement of the housing further compresses the resilient member against the disk. In so doing, the original torsional shock load is almost completely transformed into an axial shock load which is primarily absorbed by the resilient member.

The absorption of the axial shock load by the resilient member is desirable in that it reduces the measurable torsional shock sustained by the power shaft, the sleeve and the driving and driven clutch members. Without such protection, the resulting peak torque loads could otherwise exceed the strength of the power shaft and the power shaft splines which engage the sleeve. The result would be in a worst case scenario the cataclysmic failure of the engine starter gearing, and at a very minimum the inability of the engine starter gearing to slidably traverse the power shaft to engage the engine ring gear as a result of plastic deformation of the power shaft splines. While the engine starter gearing of Digby has been satisfactory in operation, it would be desirable to further reduce the effect of the torsional shock load upon the mechanical drive components of the engine starter gearing.

Such an attempt is disclosed in U.S. Pat. No. 3,915,020 to Johnson which teaches another starter gearing structure using a large, annular-shaped resilient member which circumscribes a first portion of the starter housing while being enclosed within a concentric second portion of the starter housing. Such a resilient member, being larger than the resilient member taught by Digby, theoretically has the potential for a greater ability to absorb axial shock loads transmitted from the ring gear. However, assembly of the starter gearing taught by Johnson is complicated by the requirement for the two-piece housing construction. Another disadvantage is that the physical size of the housing is larger than many applications can accommodate.

Therefore, what is needed is an improved engine starter gearing which employs a mechanical feature capable of improving the ability of the starter gearing to absorb the axial shock load transmitted via the clutch members and housing. Furthermore, what is needed is such a mechanical feature which is readily assemblable within the existing housing and which does not negatively affect the performance or function of the existing components.

SUMMARY OF THE INVENTION

The present invention provides a novel and improved engine starter gearing utilizing a series of cushion washers which significantly assist the resilient member in absorbing the torsional shock load induced by the engine during start-up and misfire of the engine while being started. Such cushion washers can be readily manufactured and assembled to the existing engine starter gearing taught by Digby. Of primary importance, the engine starter gearing of the present invention is capable of improving the ability of the engine starter gearing to absorb, and thereby dissipate, the peak torque so as to allow operation with larger engines or allow cost savings through downsizing of the gearing components.

In particular, the engine starter gearing of the present invention provides a power shaft and a sleeve which is slidably secured to the power shaft. The sleeve has helical splines adjacent one extremity thereof. A pinion gear is slidably journalled to the power shaft for axial movement relative thereto, the pinion gear being structured for movement into and out of engagement with the starting gear of the engine to be started. A driven clutch member is secured to the pinion gear for movement therewith. A circular recess is located in the driven clutch member. A driving clutch member is slidably mounted on the helical splines of the sleeve. The driving and driven clutch members have complementary mutually engageable inclined teeth for transmitting torque therebetween in one direction of relative rotation.

A housing is slidably supported on the sleeve and is provided with an open end such that the housing may be fitted over the driving and driven clutch members. The driving clutch member is positioned intermediate the open end and an oppositely disposed closed end of the housing. The driven clutch member is positioned at the open end of the housing, and both the driving and the driven clutch members are retained within the housing by abutment means engaging the driven clutch member and the housing. A biasing member is disposed within the housing and abuts the driving clutch member so as to bias the driving clutch member against the driven clutch member, thereby engaging the mutually engageable inclined teeth of the driving and driven clutch members. A radially inwardly extending shoulder is formed on the driving clutch member adjacent the recess formed in the driven clutch member. An annular thrust ring having an inner conical surface is loosely disposed in the circular recess in the driven clutch member. The annular thrust ring extends from the circular recess toward the driving clutch member and abuts the radially inwardly extending shoulder of the driving clutch member.

A plurality of centrifugal flyweight members are annularly arranged in the circular recess in the driven clutch member. The centrifugal flyweight members each have an inclined surface abutting the conical surface of the annular thrust ring. The centrifugal flyweight members are operative to displace the annular thrust ring toward the driving clutch member in response to the centrifugal force. The centrifugal flyweight members are maintained in the annular arrangement by a corresponding number of radial pins disposed within the recess and secured to the driven clutch member.

In the preferred embodiment of the present invention, a resilient member is disposed within the housing adjacent the closed end. Adjacent the resilient member and opposite the closed end are a plurality of cushion washers. Both the resilient member and the cushion washers are slidably journalled on the sleeve so as to allow axial movement relative thereto. The cushion washers about a radially outwardly extending shoulder on the sleeve such that the resilient member and the cushion washers are compressed within and against the closed end of the housing. The cushion washers enhance the ability of the resilient member to absorb the axial shock load and any residual torsional shock load produced when the pinion first engages the engine ring gear or when the engine misfires while the pinion is engaged with the engine ring gear.

Accordingly, it is an object of the present invention to provide an engine starter gearing which can better absorb torsional shock loads so as to reduce the effects of the peak torque experienced by the engine starter gearing when the pinion first engages the engine ring gear and when the engine misfires while the pinion is engaged with the engine starting gear. The present invention accomplishes this object by providing a plurality of cushion washers which cooperate with a resilient member to absorb the axial shock load and any residual torsional shock load introduced through the pinion. The cushion washers, through mechanical interactions not entirely understood, co-act among themselves to substantially reduce the torsional load over unit time as measured at the starting motor power shaft. As a result, a power dissipation capability is achieved which would not be otherwise possible with only the resilient member and the disk known to the prior art.

It is a further object of this invention to provide an engine starter gearing which is better able to absorb and dissipate the effects of peak torques and yet whose construction is no more complicated than that of the cited prior art.

It is still a further object of this invention to provide an engine starter gearing with cushion washers which can be readily manufactured and assembled to the engine starter gearing of the cited prior art for further reducing the effects of the peak torque loads imposed upon the engine starter gearing.

It is yet a further object of this invention to provide an engine starter gearing which is capable of reducing the torsional load over unit time to levels which allow operation of the starter gearing with larger engines or which allow cost savings through downsizing of the gearing components.

Other objects and advantages of this invention will be more apparent after a reading of the following detailed description taken in conjunction with the drawings provided.

DETAILED DESCRIPTION OF THE PREFERRED EMBODIMENT

Figure 1:
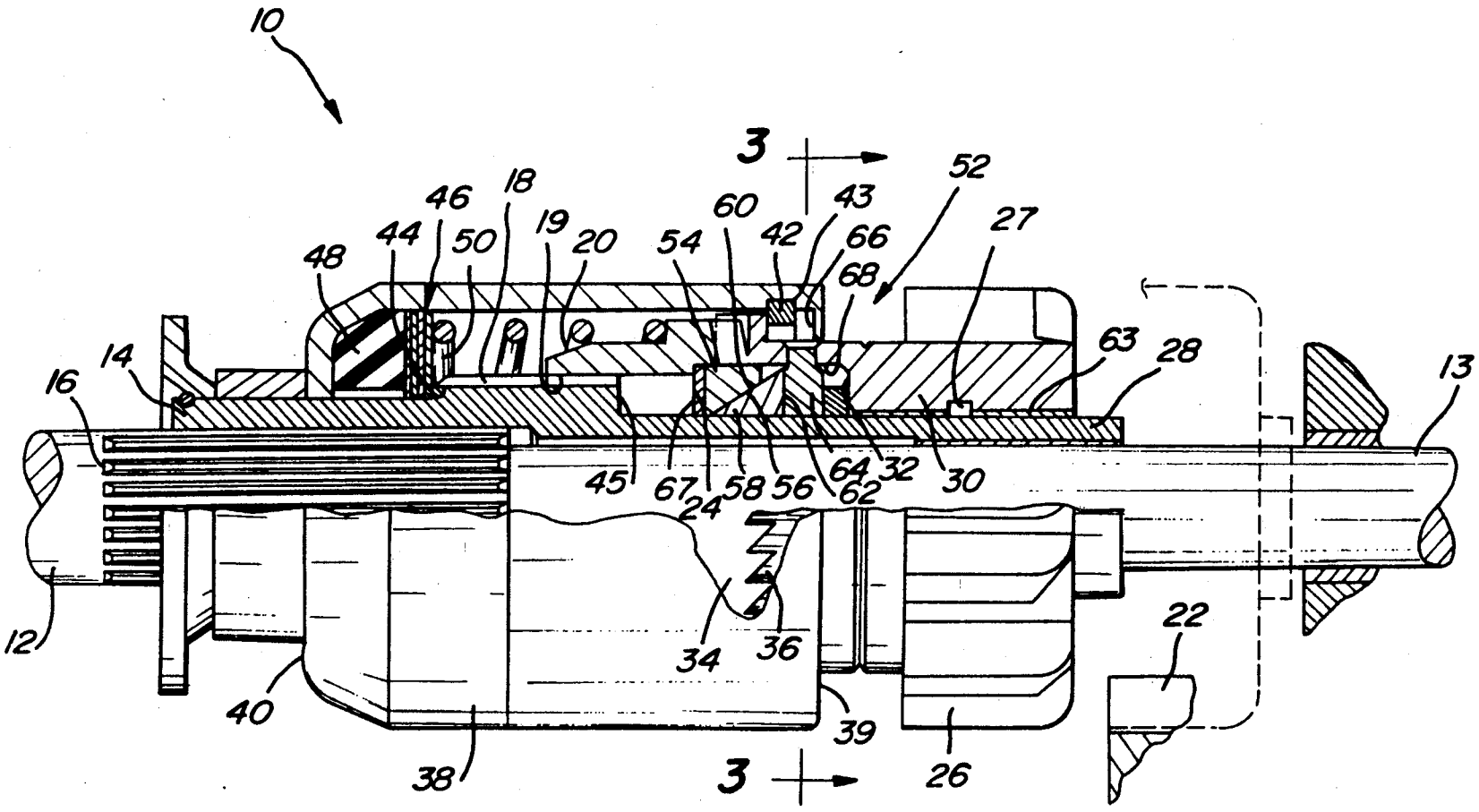
FIG. 1 is a side elevational view, partly broken away and partly in section, of an engine starter gearing according to the preferred embodiment of the present invention.

Referring to FIG. 1, there is provided a starter drive 10 for an engine (not shown) mounted to a power shaft 12 of a starting motor (not The starter drive 10 includes an axially extending sleeve 14 connected to the power shaft 12 by straight splines 16 located at the left-hand extremity, as illustrated, of the axially extending sleeve 14. The axially extending sleeve 14 is, therefore, axially but not rotatively movable relative to the power shaft 12. The axially extending sleeve 14 is formed with a reduced diameter portion 28 at its right-hand extremity, having a first radial shoulder 45 separating the reduced diameter portion 28 from the left-hand extremity of the axially extending sleeve 14. The external surface of the axially extending sleeve 14 adjacent and to the left of the first radial shoulder 45 has external helical splines 18 formed thereon. The external helical splines 18 define a second radial shoulder 44 facing the left-hand extremity of the axially extending sleeve 14. A driving clutch member 20 has internal helical splines 19 threaded onto the external helical splines 18 of the axially extending sleeve 14. The driving clutch member 20 is, therefore, adapted for helical movement towards and away from a starting gear 22 of the engine to be started.

The driving clutch member 20 is illustrated in its engaged position in FIG. 1. In the engaged position, the driving clutch member 20 projects past the first radial shoulder 45 of the axially extending sleeve 14. The rightmost edge, as illustrated, of the internal helical splines 19 of the driving clutch member 20 forms a radially inwardly extending shoulder 24, for a purpose to be described later.

The reduced diameter portion 28 of the axially extending sleeve 14 is slidably supported on a reduced diameter portion 13 of the power shaft 12. A pinion gear 26 is journalled on a bearing 63 which is press fit into the pinion gear 26. A lubrication groove 27 is located between the reduced diameter portion 28 and the pinion gear 26. The bearing 63, in turn, is slidably mounted on the reduced diameter portion 28 thereby permitting the pinion gear 26 to be axially and rotatably movable relative to the power shaft 12, the pinion gear 26 is structured for movement into and out of engagement with the starting gear 22 of the engine to be started.

A driven clutch member 30 is integrally formed with the pinion gear 26 and extends therefrom towards the driving clutch member 20. An internal circular recess 32 is provided in the driven clutch member 30 adjacent the driving clutch member 20. The internal circular recess 32 cooperates with the reduced diameter portion 28 to define an annular channel therebetween.

The adjacent faces of the driving clutch member 20 and driven clutch member 30 are provided with dentil teeth 34 and 36, respectively, which are complementary mutually engageable inclined torque transmitting dentil teeth. The dentil teeth 34 and 36 are of the sawtooth variety to provide a one-way overrunning clutch connection.

A housing 38 having an open end 39 and a closed end 40 is slidably supported at its closed end 40 on an external surface of the axially extending sleeve 14. The housing 38 is barrel-shaped and fitted over the driving clutch member 20 and partially over the driven clutch member 30. A lock ring 42 is seated in a groove 43 adjacent the open end 39 of the housing 38. The lock ring 42 has sufficient radial length to engage the driven clutch member 30 to thereby confine the driven clutch member 30 and the driving clutch member 20 within the housing 38.

The starter drive 10 is provided with a centrifugal flyweight clutch separator assembly, generally indicated by reference numeral 52, to effect disengagement of the driving clutch member 20 from the driven clutch member 30 when the engine is running above a predetermined speed. The centrifugal flyweight clutch separator assembly 52 thereby avoids excessive wear of the mutually engaging dentil clutch teeth 34 and 36.

Figure 2:
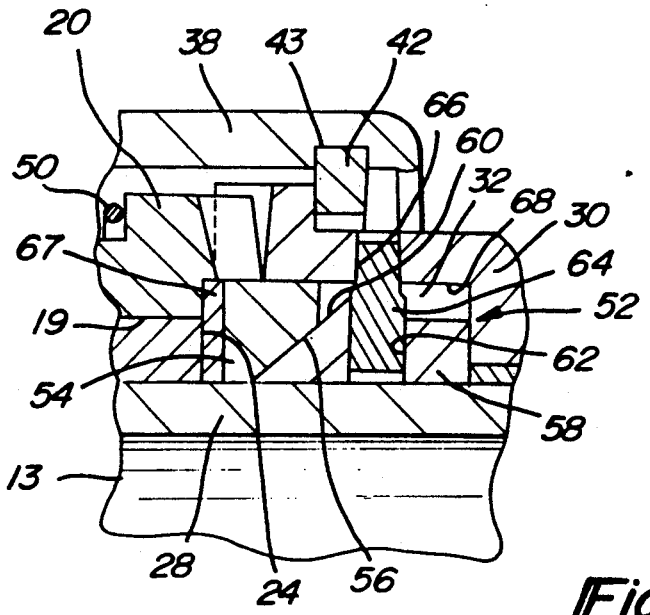
FIG. 2 is an enlarged partial cross-sectional view of the centrifugal flyweight clutch separator assembly of FIG. 1.

As best seen in FIG. 2, the centrifugal flyweight clutch separator assembly 52 includes an annular thrust washer 54 disposed within the internal recess 32. The annular thrust washer 54 is provided with a conical inner surface 56. Located between the annular thrust washer 54 and the radially inwardly extending shoulder 24 of the driving clutch member 20 is a loose thrust washer 67. A plurality of arcuate centrifugal flyweight members 58 are annularly arranged adjacent the annular thrust washer 54 and within the internal circular recess 32 of the driven clutch member 30. Each centrifugal flyweight member 58 has an inclined surface 60 complementary with and abutting the conical inner surface 56 of the annular thrust washer 54.

Figure 3:
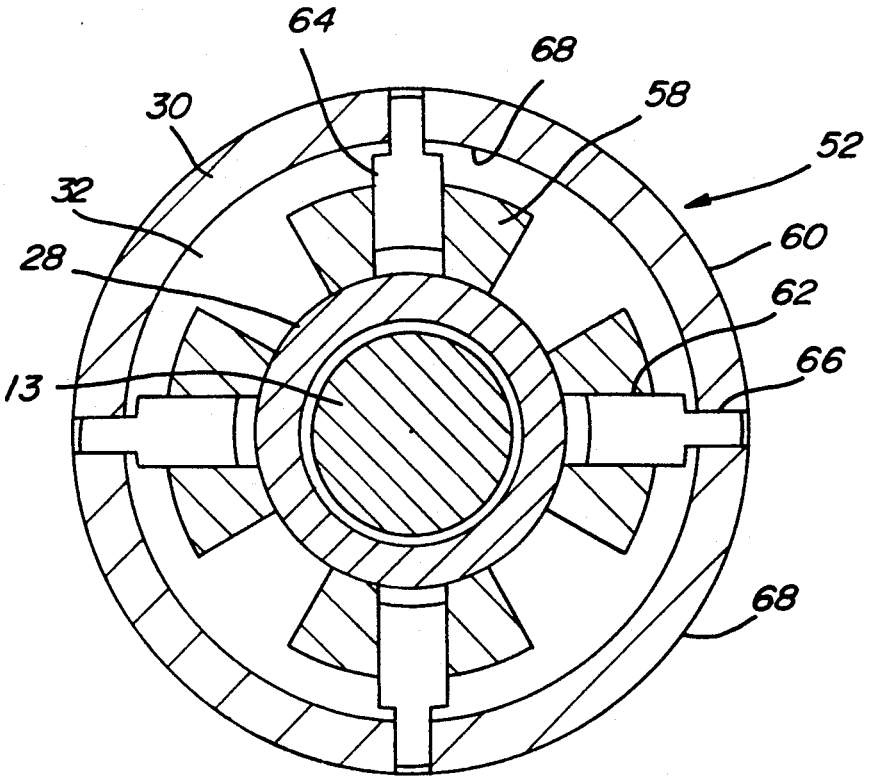
FIG. 3 is a cross-sectional view of the centrifugal flyweight clutch separator assembly of FIG. 1 taken along line 3—3.

The inward radial displacement of the centrifugal flyweight members 58 is limited by the reduced diameter portion 28 of the axially extending sleeve 14, as more clearly illustrated in FIG. 3. The internal circular recess 32 of the driven clutch member 30 has an inside surface 68 which is spaced from the centrifugal flyweight member 58 so that the centrifugal flyweight members 58 can reciprocate radially, as will be explained below. A radial hole 62 is formed in each centrifugal flyweight member 58 at a central point closely corresponding with the location of the center of gravity of the centrifugal flyweight member 58. A support pin 64 is secured at one end in a radial hole 66 formed in the driven clutch member 30 and extends from the inside surface 68 of the internal circular recess 32 to project radially inwardly into the internal circular recess 32. Each support pin 64 engages a radial hole 62 so as to support a corresponding centrifugal flyweight member 58. The support pin 64 and radial hole 62 combination restrain the centrifugal flyweight members 58 from movement in both the axial and the circumferential direction while permitting radial movement in response to centrifugal force.

In reference again to FIG. 1, the second radial shoulder 44 of the axially extending sleeve 14 provides an abutment for a plurality of cushion washers 46 slidably journalled on the axially extending sleeve 14. Preferably, the cushion washers 46 are all identically sized with each having an axial thickness substantially less then its outside diameter. Those skilled in the art can readily perform testing to ascertain the most desirable number and size of cushion washers 46 needed, according to the operational advantages which will be explained below. The cushion washers 46 are preferably formed from a high-strength steel, such as spring steel.

A resiliently yieldable annular member 48, preferably formed of an elastically deformable material such as rubber, is compressively confined between the cushion washers 46 and the closed end 40 of the housing 38. A resilient spring member 50 is compressively confined within the housing 38 between the cushion washers 46 and the driving clutch member 20 to provide a biasing force urging the driving clutch member 20 into engagement with the driven clutch member 30.

An advancement apparatus, not illustrated in the drawings but well known in the art, is provided for moving the starter drive 10 towards and away from the starting gear 22 of the engine.

In operation, when it is desired to crank the engine, the starter drive 10 is shifted to the right via the shifting mechanism (not illustrated) so that the pinion gear 26 engages the starting gear 22. The power shaft 12 is rotated by a starting motor (not illustrated) and transmits torque through the straight splines 16 to the axially extending sleeve 14, and from the helical splines 18 to the driving clutch member 20. The driving clutch member 20 drives the driven clutch member 30 through the dentil teeth 34 and 36. The driven clutch member 30 thereby rotates the pinion gear 26 and the starting gear 22 of the engine.

At initial engagement, the starter drive 10 must overcome the inertial mass and the internal friction of the engine. Consequently, a peak torque load is imposed on the components of the starter drive 10, particularly the power shaft 12. This torque load is transmitted to the driving clutch member 20 through the driven clutch member 30 via the dentil teeth 34 and 36. As a result of the driving clutch member 20 being engaged with the axially extending sleeve 14 via the helical splines 18 and 19, the torque load is transformed into an axial shock load which urges the driving clutch member 20, and consequently the pinion gear 26 and driven clutch member 30 via the meshed dentil clutch teeth, toward the engine starting gear 22.

As a result of the axial displacement of the driven clutch member 30 being restricted relative to the housing 38, the housing 38 is also urged toward the engine starting gear 22. This displacement of the housing 38 further compresses the resilient member 48 and the cushion washers 46, thereby dissipating within the resilient member 48 and the cushion washers 46 the original torsional shock as an axial shock. Such absorption of the torsional shock by the cushion washers 46 and the resilient member 48 reduces the measurable torsional shock sustained by the power shaft 12, the axially extending sleeve 14 and the driving and driven clutch members 20 and 30.

More importantly for purposes of the present invention, the cushion washers 46 act to reduce the torsional load over unit time (power dissipated) by extending the time over which the torque is transferred through the starter drive 10. Though this physical phenomenon is not entirely understood, the inclusion of the cushion washers 46 has been found to significantly improve the ability of the starter drive 10 to lengthen the time it takes to transfer the torsional shock load from the starting gear 22 through the mechanical drive components of the engine starter drive 10, thus ensuring that the torsional loads are elastically transferred to the resilient member 48 and not inelastically isolated at the power shaft 12 adjacent the pinion gear 26. The data below illustrates a reduction of nearly ten percent in the power dissipation capability of the present invention under laboratory conditions wherein a starter drive 10 was energized via a starter motor while engaged with a stationary starting gear 22.

| Test Condition | Peak Torque Measured (ft-lbs) | Time to Dissipate (millisec) | Power Dissipation (kilowatts) |
|---|---|---|---|
| without cushion washers 46 | 242.29 | 4.10 | 43.6 |
| with cushion washers 46 | 248.84 | 4.66 | 39.4 |

The benefits of such an effect are that the peak torque is capable of being more fully transmitted to the resilient member 48, the tendency to isolate the peak torque effects at the reduced diameter portion 13 of the power shaft 12 is reduced, and the peak torque is less likely to be inelastically transmitted to the starter motor directly through the power shaft 12, in comparison with the prior art.

Continuing with the previous description of operation, once the engine fires and becomes self-operating, the starting gear 22 will drive the pinion gear 26 at a speed greater than that of the power shaft 12. The dentil teeth 34 and 36 will slip so that the starting motor is not driven at a high engine speed. In order to protect the dentil teeth 34 and 36 from severe wear due to the rubbing and clashing which would otherwise occur, and further to avoid unnecessary noise, the rapid rotation of the driven clutch member 30 drives the centrifugal flyweight members 58 radially outward. The movement of each centrifugal flyweight member 58 is guided by its corresponding support pin 64 so as to prevent any motion of the centrifugal flyweight members 58 relative to the driven clutch member 30 other than the desired radial motion.

The radially outward motion of the centrifugal flyweight members 58 will bring the inclined surface 60 of the centrifugal flyweight members 58 into engagement with the conical inner surface 56 of the annular thrust washer 54, urging the annular thrust washer 54 to the left against the biasing force of the resilient spring member 50, as illustrated in FIG. 1. This motion of the annular thrust washer 54 is transferred through the loose thrust washer 67 to the radially inwardly extending shoulder 24 of the driving clutch member 20, causing a separation between the driving clutch member 20 and the driven clutch member 30.

However, it is not uncommon for an engine to misfire during the starting operation, producing an additional peak torque imposed on the engine starter gearing components. This peak torque is accentuated if the dentil teeth 36 of driven clutch member 30 have already disengaged the dentil teeth 34 of the driving clutch member 20 such that the relative speed between the two is significant. Under such circumstances, the misfire will suddenly cause the driven clutch member 30 to reengage the driving clutch member 20, imparting an instantaneous torsional load on the drive components, particularly the power shaft 12. Again, it has been determined that the combination of the cushion washers 46 with the resilient member 48 significantly improves the ability of the drive components to survive by better absorbing and dissipating the torsional load over an extended period of time.

Accordingly, it is of primary concern for purposes of the present invention that the plurality of cushion washers 46 are capable of significantly improving the transfer of the peak torques to the resilient member 48 for absorbing the peak torques introduced by the engine's starting gear. For this reason, the starter drive 10 disclosed above has an advantage over the prior art in which the resilient member 48 alone is required to dissipate the torsional shock. In addition, it will be readily appreciated by those skilled in the art that the cushion washers 46 are extremely easy and inexpensive to form, in comparison with other forms of power dissipation devices known in the art. Furthermore, the cushion washers 46 are capable of reducing the torsional load over unit time to power dissipation levels which allow operation with larger engines or which allow cost savings through downsizing of the gearing components.

While the invention has been described in terms of a preferred embodiment, it is apparent that other forms could be adopted by one skilled in the art. Accordingly, the scope of the invention is to be limited only by the following claims.

What is claimed is:

1. An engine starter gearing for selectively starting an engine having a starting gear, said engine starter gearing comprising:

a power shaft having an axis of rotation;

a sleeve slidably, but non-rotatably, secured to said power shaft, said sleeve having external helical splines formed on a surface thereof, said sleeve having an abutment adjacent said external helical splines;

a pinion gear slidably journalled to said power shaft for axial movement relative thereto, said pinion gear being structured for movement into and out of engagement with said starting gear of said engine to be started;

a driving clutch member slidably mounted on said sleeve, said driving clutch member having internal helical splines engaging said external helical splines formed on said sleeve;

a driven clutch member integral with said pinion gear and disposed adjacent to said driving clutch member, said driven clutch member having an internal recess formed adjacent said driving clutch member;

complementary mutually engageable inclined teeth for transmitting torque therebetween in one direction of rotation provided on facing surfaces of said driving and driven clutch members;

flyweight retention means disposed within said internal recess formed in said driven clutch member;

a radially inwardly extending shoulder formed on said driving clutch member adjacent said internal recess of said driven clutch member;

an annular thrust washer disposed in said internal recess of said driven clutch member between said flyweight retention means and said driving clutch member, said annular thrust washer having an inner conical surface, said annular thrust washer being operative to engage said radially inwardly extending shoulder and axially displace said driving clutch member when said annular thrust washer is axially displaced away from said driven clutch member;

a plurality of centrifugal flyweight members retained by said flyweight retention means within said internal recess of said driven clutch member, said plurality of centrifugal flyweight members being arranged annularly within said internal recess by said flyweight retention means, each of said plurality of centrifugal flyweight members having an inclined surface abutting said inner conical surface of said annular thrust washer, each of said plurality of centrifugal flyweight members being operative to be radially displaced in response to centrifugal forces generated by a high speed rotation of said drive clutch member, the radial displacement of said plurality of centrifugal flyweight members axially displacing said annular thrust washer and said driving clutch member in a direction away from said driven clutch member, the axial displacement of said driving clutch member from said driven clutch member disengaging said complementary mutually engageable inclined teeth;

a housing having an open end, said housing being slidably supported on said sleeve and spatially encompassing said driving clutch member and a portion of said driven clutch member;

abutment means disposed within said housing for retaining said driving clutch member and said portion of said driven clutch member within said housing;

biasing means disposed within said housing for biasing said driving clutch member towards said driven clutch member and said complementary mutually engageable inclined teeth into mutual engagement; and a plurality of disks disposed between said biasing means and said housing, said plurality of disks compressibly abutting said abutment of said sleeve.

2. The engine starter gearing of claim 1 wherein said disks are formed of spring steel.

3. The engine starter gearing of claim 1 further comprising resilient means disposed between said plurality of disks and said housing.

4. The engine starter gearing of claim 3 wherein said resilient means is precompressed between said plurality of disks and said housing.

5. An engine starter gearing for selectively starting an engine having a starting gear, said engine starter gearing comprising:

a power shaft having an axis of rotation;

a sleeve slidably, but non-rotatably, secured to said power shaft, said sleeve having external helical splines formed on a surface and adjacent one end thereof, said sleeve having a radially outwardly extending shoulder between said external helical splines and said one end;

a pinion gear slidably journalled to said power shaft for axial movement relative thereto, said pinion gear being structured for movement into and out of engagement with said starting gear of said engine to be started;

a driving clutch member slidably mounted on said sleeve, said driving clutch member having internal helical splines engaging said external helical splines formed on said sleeve;

a driven clutch member secured to said pinion gear and disposed adjacent to said driving clutch member, said driven clutch member having an internal recess formed adjacent said driving clutch member;

complementary mutually engageable inclined teeth for transmitting torque therebetween in one direction of rotation provided on facing surfaces of said driving and driven clutch members;

flyweight retention means disposed within said internal recess formed in said driven clutch member;

a radially inwardly extending shoulder formed on said driving clutch member adjacent said internal recess of said driven clutch member;

an annular thrust washer disposed in said internal recess of said driven clutch member between said flyweight retention means and said driving clutch member, said annular thrust washer having an inner conical surface, said annular thrust washer being operative to engage said radially inwardly extending shoulder and axially displace said driving clutch member when said annular thrust washer is axially displaced away from said driven clutch member;

a plurality of centrifugal flyweight members retained by said flyweight retention means within said internal recess of said driven clutch member, said plurality of centrifugal flyweight members being arranged annularly within said internal recess by said flyweight retention means, each of said plurality of centrifugal flyweight members having an inclined surface abutting said inner conical surface of said annular thrust washer, each of said plurality of centrifugal flyweight members being operative to be radially displaced in response to centrifugal forces generated by a high speed rotation of said driven clutch member, the radial displacement of said centrifugal flyweight members axially displacing said annular thrust washer and said driving clutch member in a direction away from said driven clutch member, the axial displacement of said driving clutch member from said driven clutch member disengaging said complementary mutually engageable inclined teeth;

a housing having an open end and an oppositely disposed closed end, said housing being slidably supported on said sleeve and spatially encompassing said driving clutch member and a portion of said driven clutch member;

abutment means disposed within said housing adjacent said open end, said abutment means retaining said driving clutch member and said portion of said driven clutch member within said housing;

resilient means disposed within said housing adjacent said closed end;

a plurality of cushion washers disposed adjacent said resilient means and opposite said closed end, said plurality of cushion washers being slidably journalled on said sleeve and compressibly abutting said radially outwardly extending shoulder; and a compression spring disposed within said housing between said plurality of cushion washers and said driving clutch member, said compression spring biasing said driving clutch member towards said driven clutch member and said complementary mutually engageable inclined teeth into axial engagement, said compression spring biasing said plurality of cushion washers towards and against said resilient means.

6. The engine starter gearing of claim 5 wherein said resilient means is an elastically-deformable material.

7. The engine starter gearing of claim 5 wherein said resilient means is precompressed between said plurality of cushion washers and said closed end of said housing.

8. The engine starter gearing of claim 5 wherein said cushion washers are formed of spring steel.

9. The engine starter gearing of claim 5 wherein said plurality of centrifugal flyweight members comprises three annularly arranged centrifugal flyweight members.

10. The engine starter gearing of claim 5 wherein said flyweight retention means is a plurality of radial support pins connected to said driven clutch member and wherein each of said plurality of centrifugal flyweight members has a radial aperture therethrough, each of said plurality of radial support pins engaging a corresponding one of said radial apertures of a corresponding one of said plurality of centrifugal flyweight members so as to allow radial displacement of said corresponding one of said plurality of centrifugal flyweight members.

11. In a centrifugally disengageable engine starter gearing for selectively starting an engine having a starting gear, the engine starter gearing having a power shaft, a sleeve slidably secured to said power shaft, said sleeve having a radially outwardly extending shoulder, a pinion gear slidably mounted to said power shaft and movable into engagement with said starting gear, a driven clutch member secured to said pinion gear and having an internal recess therein, flyweight retention means disposed within said internal recess of said driven clutch member, a plurality of flyweight members annularly retained by said flyweight retention means, each of said plurality of flyweight members having an inclined surface, a driving clutch member mounted to said sleeve, mutually engageable teeth on said driving and driven clutch members, a housing fitted over said driving and driven clutch members, an abutment confining said driving and driven clutch members within said housing, a biasing member biasing said driving and driven clutch members into mutual engagement, a resilient member axially disposed between said housing and said radially outwardly extending shoulder of said sleeve, a radially inwardly extending shoulder on said driving clutch member adjacent said internal recess, an annular thrust washer having an inner conical surface abutting said inclined surface of each of said plurality of flyweight members, said annular thrust washer abutting a loose washer which, in turn, abuts said radially inwardly extending shoulder of said driving clutch member, the improvement comprising:

a plurality of cushion washers disposed between said radially outwardly extending shoulder and said resilient member, said plurality of cushion members being slidably journalled on said sleeve.

12. The engine starter gearing of claim 11 wherein said resilient means is an elastically-deformable material.

13. The engine starter gearing of claim 11 wherein said resilient means is precompressed between said plurality of cushion washers and said closed end of said housing.

14. The engine starter gearing of claim 11 wherein said cushion washers are formed of spring steel.

* * * * *

UNITED STATES PATENT AND TRADEMARK OFFICE

CERTIFICATE OF CORRECTION

PATENT NO. : 5,237,882

DATED : August 24, 1993

INVENTOR(S) : Paul F. Giometti

It is certified that error appears in the above-identified patent and that said Letters Patent is hereby corrected as shown below:

Column 4, line 15, delete "about" and insert ---- abut ----.

Column 5, line 14, after "not" insert ---- shown). ----.

Column 6, line 63, delete "then" and insert ---- than ----.

Column 10, line 8, delete "drive" and insert ---- driven ----.

Signed and Sealed this

Twenty-ninth Day of March, 1994

Bruce Lehman

*Attest:*

BRUCE LEHMAN

*Attesting Officer*

*Commissioner of Patents and Trademarks*